US011260265B2

(12) United States Patent
Jiang

(10) Patent No.: US 11,260,265 B2
(45) Date of Patent: Mar. 1, 2022

(54) STATIONARY BIKE

(71) Applicant: Peigen Jiang, Sammamish, WA (US)

(72) Inventor: Peigen Jiang, Sammamish, WA (US)

( * ) Notice: Subject to any disclaimer, the term of this patent is extended or adjusted under 35 U.S.C. 154(b) by 40 days.

(21) Appl. No.: 16/207,203

(22) Filed: Dec. 3, 2018

(65) Prior Publication Data

US 2020/0171347 A1 Jun. 4, 2020

(51) Int. Cl.
*A63B 22/06* (2006.01)
*A63B 23/02* (2006.01)

(52) U.S. Cl.
CPC ..... *A63B 22/0605* (2013.01); *A63B 23/0216* (2013.01); *A63B 23/0233* (2013.01); *A63B 2022/0652* (2013.01)

(58) Field of Classification Search
CPC ..... A63B 22/0605; A63B 23/0216; A63B 23/0233; A63B 2022/0611–0658; A63B 21/4041; A63B 21/4047; A63B 2208/0228; A63B 2208/0233; A47C 9/002; A47C 1/022; A47C 1/023; A47C 1/024
USPC ..... 297/284.3, 284.4, 354.1
See application file for complete search history.

(56) References Cited

U.S. PATENT DOCUMENTS 3,540,777 A * 11/1970 Revelli ..... B60N 2/2222 297/284.4
4,770,411 A * 9/1988 Armstrong ..... A63B 22/0605 482/64
4,836,536 A * 6/1989 Jones ..... A63B 23/0211 482/134
4,850,587 A * 7/1989 Lin ..... A63B 21/154 482/72
5,254,067 A * 10/1993 Habing ..... A63B 22/0056 482/112
5,569,128 A * 10/1996 Dalebout ..... A63B 22/0007 482/57
5,573,485 A * 11/1996 Geschwender .... A63B 23/0233 482/112
7,381,162 B2 * 6/2008 Kuo ..... A63B 22/0605 297/344.15
7,475,943 B1 * 1/2009 Huang ..... A47C 7/405 297/284.4
7,736,281 B2 * 6/2010 Corbalis ..... A63B 22/0605 248/444.1
8,062,190 B2 * 11/2011 Pyles ..... A63B 22/0605 482/51
8,814,764 B2 * 8/2014 Vaughns ..... A63B 21/155 482/101
2004/0005971 A1 * 1/2004 Kuo ..... A63B 23/0233 482/142

(Continued)

*Primary Examiner* — Garrett K Atkinson
*Assistant Examiner* — Kathleen M Fisk

(57) ABSTRACT

A stationary bike includes a flywheel mounted to a frame, and a chair coupled to the frame, the chair having a first, a second and a third section each having a flat area, wherein the flat area of the first section is substantially horizontal for supporting a user's buttocks when the user is in a sitting posture, the flat area of the second section forms a first angle to a vertical plane for the user's lower back to lean against when in the sitting posture, and the flat area of the third section forms a second angle to the vertical plane which is larger than the first angle, when the user's upper back rests on the third section, the user's lower back and buttocks are raised above the second section and the first section, respectively.

9 Claims, 3 Drawing Sheets

(56) References Cited

U.S. PATENT DOCUMENTS

| | | | | |
|---|---|---|---|---|
| 2005/0093352 | A1* | 5/2005 | Yasuda | B60N 2/2222 297/284.1 |
| 2005/0272581 | A1* | 12/2005 | Stearns | A63B 21/055 482/140 |
| 2009/0211395 | A1* | 8/2009 | Mul'e | A63B 22/0046 74/594.7 |
| 2012/0184410 | A1* | 7/2012 | Foster | A63B 21/023 482/8 |
| 2013/0190142 | A1* | 7/2013 | Vaughns | A63B 23/0211 482/98 |

* cited by examiner

STATIONARY BIKE

BACKGROUND

The present invention relates generally to stationary bikes, and, more particularly, to a stationary bike that can facilitate core exercise.

Various stationary bikes have been developed for indoor exercises. They generally simulate road bike's exercise: the user peddles with his or her feet in a circular motion while sits on a seat. Although it is desirable to make the stationary bike provide a similar exercise to a road bike, these stationary bikes work mostly just legs due to the sitting position, thus are less efficient in terms of whole-body exercise. What is desired is a stationary bike that can work not only legs but also the upper body.

SUMMARY

A stationary bike is disclosed which comprises a flywheel mounted to a frame, and a chair coupled to the frame, the chair having a first, a second and a third section each having a flat area, wherein the flat area of the first section is substantially horizontal for supporting a user's buttocks when the user is in a sitting posture, the flat area of the second section forms a first angle to a vertical plane for the user's lower back to lean against when in the sitting posture, and the flat area of the third section forms a second angle to the vertical plane which is larger than the first angle, when the user's upper back rests on the third section, the user's lower back and buttocks are raised above the second section and the first section, respectively. In another embodiment, the third section is pivotal around a horizontal axis allowing the user's buttocks and lower back to be raised while his or her upper back rests on the pivotal third section.

Figure 1A:
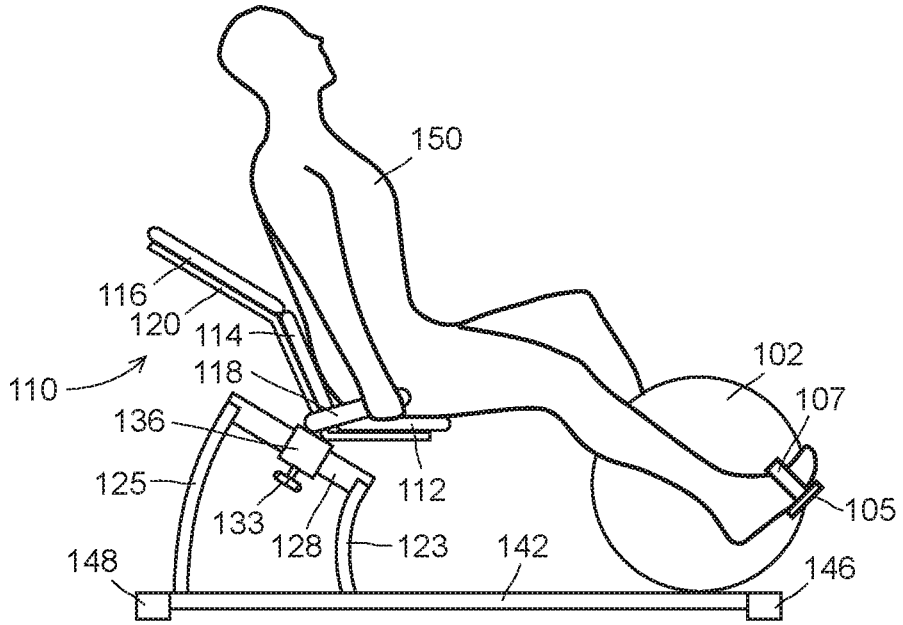
FIGS. 1A and 1B illustrate a stationary bike in use according to an embodiment of the present disclosure.

The drawings accompanying and forming part of this specification are included to depict certain aspects of the invention. A clearer conception of the invention, and of the components and operation of systems provided with the invention, will become more readily apparent by referring to the exemplary, and therefore non-limiting, embodiments illustrated in the drawings, wherein like reference numbers (if they occur in more than one view) designate the same elements. The invention may be better understood by reference to one or more of these drawings in combination with the description presented herein.

DESCRIPTION

The present disclosure relates to a stationary bike. A preferred embodiment of the present disclosure will be described hereinafter with reference to the attached drawings.

Figure 1B:
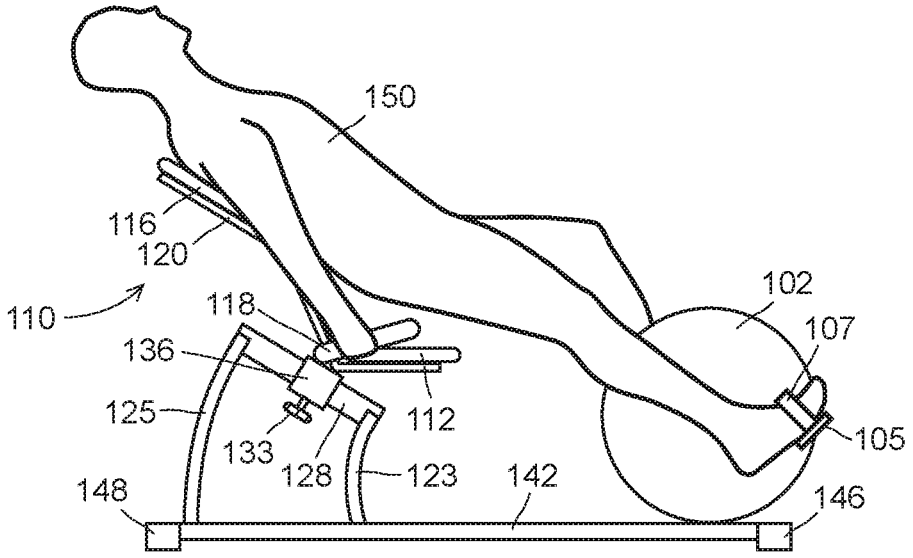

FIGS. 1A and 1B illustrate a stationary bike in use according to an embodiment of the present disclosure. Referring to FIG. 1A, the stationary bike includes a flywheel 102 mounted on a base frame 142 and a chair 110 for a user 150 to sit on. The base frame 142 has horizontally extended members 146 and 148 to keep the stationary bike in an upright position. The chair 110 slidably coupled to the base frame 142 includes a seat section 112, a lower back section 114 and an upper back section 116. Each section 112, 114 or 116 has a flat area to support different part of the user 150's body. The flat area of the seat section 112 is approximately horizontal for being sat upon. The flat area of the lower back section 114 forms a small angle, generally less than ten degrees, to a vertical plane. The flat area of the upper back section 116 form a larger angle, thirty degrees for instance, to the vertical plane. In this embodiment, the aforementioned parts of the chair 110 are fixed at factory.

As shown in FIG. 1A, when the user 150 sits upright, his or her his lower back leans against the lower back section 114. The user 150 places his right foot on a pedal 105 under a strap 107 and his left foot on another pedal (not shown) for pedaling the flywheel 102 during an exercise session, while resting a hand on a handle 118.

Referring to FIG. 1A again, the chair 110 is rigidly mounted on a slider 136 which can slide back and forth along a rail 128. A support member 120 of the chair 110 connects the upper back section 116, the lower back section 114 and the seat section 112 to the slider 136. The slider 136 employs a locking mechanism 133 for locking the slider 136 to a desired location of the rail 128. The locking mechanism may be implemented by a spring-loaded pin mounted on the slider 136 and a plurality of holes presented along the length of the rail 128 which can accommodate the pin. When the pin is urged by the spring toward the rail 128, the pin and one of the plurality of holes engage, thus locking the slider 136 to a particular location of the rail 128. When the pin is pulled away from and disengages the rail 128, the slider 136 is free to move along the rail 128. In another embodiment, the pin is threaded to facilitate its movement to and from the rail. As shown in FIG. 1A, the locking mechanism 133 is installed on an underside of the rail 128. Alternatively, the locking mechanism 133 can instead be installed on one or both sides of the rail 128.

As shown in FIG. 1A, the rail 136 is secured to the base frame 142 by vertical supports 123 and 125. In embodiments, the vertical supports 123 and 125 are welded to the base frame 142, while the rail 128 is screw mounted to the vertical supports 123 and 125. In one embodiment, the rail 136 and the base frame 142 form an approximately thirty-degree angle so that an extrapolation of the rail 128 is approximately in a tangent of a circumference of the flywheel 102, so that the stationary bike may provide users of different heights with a similar exercise posture by sliding the chair 110 back and forth along the rail 128. In embodiments, the upper back section 116 is approximately parallel to the rail 128.

Referring to FIG. 1B, the user 150 straightens his body with his buttocks and lower back raised and his upper back resting on the upper back section 116 of the chair 110. In this posture, the user 150's buttocks and lower back are not supported by the chair, instead are supported by his own core and arm muscles (right hand still on the handle 118). In this posture, the user 150 can exercise not only leg muscles but also core and arm muscles.

Figure 2A:
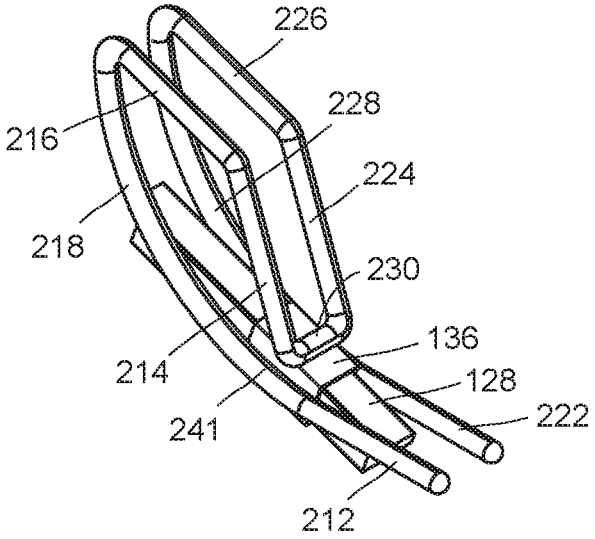
FIGS. 2A and 2B illustrate a chair frame according to an embodiment of the present disclosure.
Figure 2B:
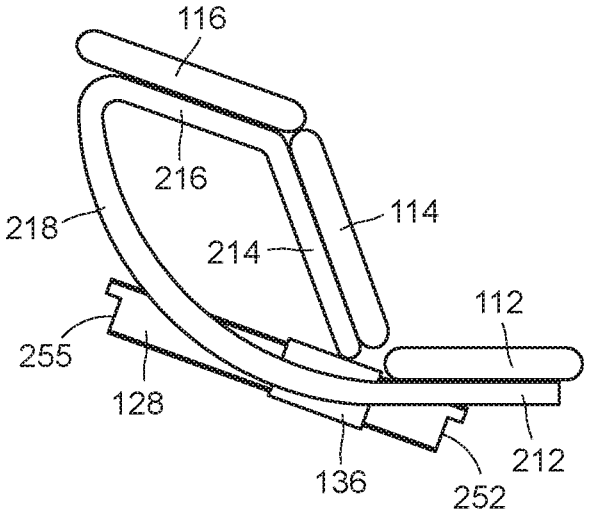

FIGS. 2A and 2B illustrate a chair frame according to an embodiment of the present disclosure. The chair frame is made of a tube bended into two parallel D-shaped frames with multiple sections. Parallel sections 212 and 222 are for mounting the seat section 112. Parallel sections 214 and 224 are for mounting the lower back section 114. Parallel sections 216 and 226 are for mounting the upper back section 116. Section 218 is connected to an end of the section 216 and functions as a support for the upper back section 116. A bottom end of the section 218 is secured to the glider 136 at location 241 by either welding or screws and is also connected to the section 212. Similarly, section 228 is connected to an end of the section 226 and also functions as a support for the upper back section 116. A bottom end of the section 228 is also secured to the glider 136 by either welding or screws and is also connected to the section 222. A horizontal section 230 connects sections 214 and 224 and is secured to the glider 136 by either welding or screws. Thus, the so formed chair frame is rigidly connected to the glider 138. As the user 150 may rest his upper body on the upper back section 116, the section 218 provides an additional support for the upper back section 116. In another embodiment, the sections 212, 214, 216 and 218 may be formed by cutting out a desired shape from a panel. In this case, support for the upper back section 116 is defined by two edges: a first edge borders the lower back section 114 and near a front of the upper back section 116, and a second edge is away from the first edge and situated toward a rear of the upper back section 116.

Referring to FIG. 2B, notches 252 and 255 are formed at respective ends of the rail 128 for accommodating the vertical support 123 and 125, respectively. In another embodiment, the rail 128 and the vertical support 123 and 125 are formed by cutting out a desired shape from a panel.

Figure 3A:
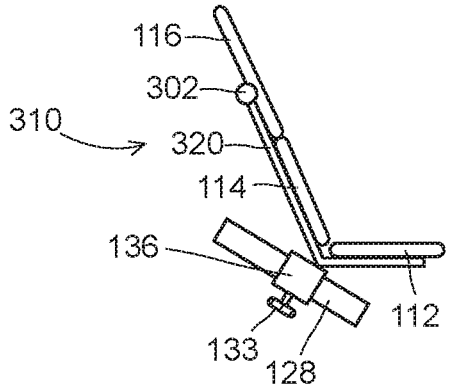
FIGS. 3A and 3B illustrate a chair according to another embodiment of the present disclosure.
Figure 3B:
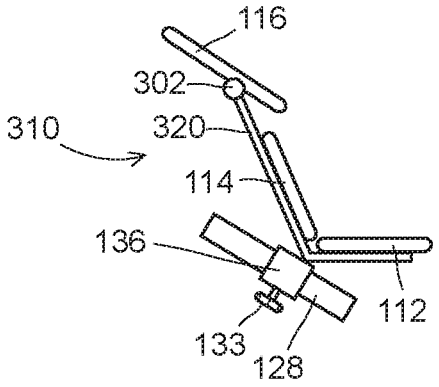

FIGS. 3A and 3B illustrate a chair 310 according to another embodiment of the present disclosure. The chair 310 also have three distinct sections 112, 114 and 116 as shown in FIG. 1A. However, the upper back section 116 can pivot around a horizontal axis 302 at the push of a user's upper back. The horizontal axis 302 is fixed to a frame 320 of the chair 310 and is located above the lower back section 114. As shown in FIG. 3A, the upper back section 116 pivots to align with the lower back section 114 for a user to sit upright on the chair 310. As shown in FIG. 3B, the upper back section 116 pivots to a more recumbent angle when the user's body straightens up in a posture shown in FIG. 1B. In an embodiment, the axis 302 is located at about a middle point of the upper back section 116.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and, in a manner, consistent with the scope of the invention, as set forth in the following claims.

What is claimed is:

1. A stationary bike comprising:

a pair of foot pedals coupled to a frame; and a chair coupled to the frame, the chair having a first, a second and a third section each having a flat surface for supporting a different part of a user's body, the third section being a highest part of the chair, wherein the flat surface of the first section is configured for supporting the user's buttocks when the user is in a sitting posture, the flat surface of the second section forms a first angle to a vertical plane, and the third section is separated from the second section and configured to pivot around a horizontal axis to form a second angle to the vertical plane while the second section remains fixed, wherein the second angle is larger than the first angle, wherein the third section is configured so that when the user's straightened body is longitudinally parallel to the flat surface of the third section while his or her upper back rests thereon, the user's buttocks and lower back do not contact the first section and the second section, respectively, wherein the third section is only supported at a vicinity of the horizontal axis.

2. The stationary bike of claim 1, wherein the chair is slidably coupled to the frame with the chair rigidly mounted to a slider which is slidably secured to a rail on the frame.

3. The stationary bike of claim 2, wherein the rail forms an angle relative to a horizontal plane.

4. The stationary bike of claim 3, wherein the angle to the horizontal plane is about thirty degrees.

5. The stationary bike of claim 2, further comprising a pin for locking the slider to the rail.

6. The stationary bike of claim 1, wherein the pair of foot pedals is connected to a flywheel.

7. The stationary bike of claim 1, wherein the horizontal axis is between a middle point and an end of the third section adjacent to the second section.

8. The stationary bike of claim 1, further comprising a handle mounted to the chair.

9. The stationary bike of claim 1, further comprising a support member connected between the horizontal axis and the slider.

* * * * *